US006206599B1

(12) United States Patent
Buchanan et al.

(10) Patent No.: US 6,206,599 B1
(45) Date of Patent: Mar. 27, 2001

(54) PAINT ROLLER HANDLE CONSTRUCTION HAVING A SELF CONTAINED PAINT SUPPLY

(76) Inventors: Franklyn Buchanan; Hyacinth V. Buchanan, both of 6259 Old Yord Rd., Philadelphia, PA (US) 19141

( * ) Notice: Subject to any disclaimer, the term of this patent is extended or adjusted under 35 U.S.C. 154(b) by 0 days.

(21) Appl. No.: 09/603,280

(22) Filed: Jun. 26, 2000

(51) Int. Cl.[7] ..... B05C 1/00
(52) U.S. Cl. ..... 401/197; 401/219
(58) Field of Search ..... 401/219, 208, 401/218, 197, 187, 188

(56) References Cited

U.S. PATENT DOCUMENTS

| | | | | |
|---|---|---|---|---|
| 3,231,151 | * | 1/1966 | Clark et al. | 401/197 |
| 3,337,899 | * | 8/1967 | Rentfrow | 401/197 |
| 3,539,268 | | 11/1970 | Stebbins | 401/197 |
| 3,554,659 | * | 1/1971 | Stokes | 401/197 |
| 4,175,300 | | 11/1979 | McGlew et al. | 15/103.5 |
| 4,659,243 | * | 4/1987 | Winson | 401/197 |
| 4,842,432 | | 6/1989 | Snetting | 401/197 |
| 4,997,302 | | 3/1991 | Simonette | 401/170 |
| 5,769,769 | | 6/1998 | Torntore | 492/13 |

* cited by examiner

*Primary Examiner*—David J. Walczak
(74) *Attorney, Agent, or Firm*—Henderson & Sturm LLP

(57) ABSTRACT

A paint roller handle construction (10) for delivering an on demand supply of paint to a porous paint roller (100). The handle construction (10) includes an elongated contoured hollow handle member (20) having a generally straight inboard end (21) and a generally U-shaped outboard end (22) which terminates in an elongated apertured axle element (30) having a generally bulbous inboard end (32), and a paint supply unit (12) that includes a pump member (40) disposed within and adapted to supply pressurized air both through the hollow handle member (20) and to a paint supply reservoir (50). Both pressurized air and pressurized paint are mixed within the bulbous inboard end (32) of the axle member (30) for distribution through the apertures (34) in the axle member (30) onto a porous paint roller (100).

9 Claims, 1 Drawing Sheet

PAINT ROLLER HANDLE CONSTRUCTION HAVING A SELF CONTAINED PAINT SUPPLY

BACKGROUND OF THE INVENTION

1. Field of the Invention

The present invention relates to the field of paint applicators having a self contained supply of paint in general, and in particular to a paint applicator having a split air flow pressurization to both force and disperse a supply of paint delivered to an applicator surface.

2. Description of Related Art

As can be seen by reference to the following U.S. Pat. Nos. 3,539,268; 4,175,300; 4,842,432; 4,997,302; 5,769,769, the prior art is replete with myriad and diverse paint rollers having a supply of paint delivered under pressure directly to the roller surface.

While all of the aforementioned prior art constructions are more than adequate for the basic purpose and function for which they have been specifically designed, they are uniformly deficient with respect to their failure to provide a simple, efficient, and practical hand held paint roller applicator handle construction having an air pump arrangement that both pressurizes a paint containing reservoir for delivery of paint to a roller, but which also assists in the pressurization and distribution of the paint along a porous paint roller axle.

As most people who employ paint rollers are all too well aware, the major drawback with this type of device is the repeated need to replenish the supply of paint on the exterior surface of the paint roller.

As a result, several prior art attempts as mentioned above have been developed to address this system by supplying paint under pressure into the interior of the hollow paint roller. Unfortunately, these prior art constructions were either two unwieldily in that they required a stationary paint reservoir that delivered paint under pressure through a long flexible hose to the roller applicator. Or, as in the case of the Simonette patent (U.S. Pat. No. 4,997,302) required an extremely long handled reservoir that would serve as a pumping station to deliver paint to the roller surface.

As a consequence of the foregoing situation, there has existed a longstanding need for a new and improved and practical paint roller handle construction that would closely resemble the non-powered manual paint roller handles that are in common usage today, but which would also be intended to deliver a pressurized supply of paint to the porous roller surface, and the provision of such a construction is a stated objective of the present invention.

BRIEF SUMMARY OF THE INVENTION

Briefly stated, the handle construction that forms the basis of the present invention comprises in general, a roller support unit, and a pressurized paint delivery unit that cooperates with the roller support unit to deliver separate streams of pressurized air and pressurized paint into the interior of a porous paint roller.

As will be explained in greater detail further on in the specification, the roller support unit includes an elongated contoured hollow handle member having a generally straight inboard end provided with a pressurization chamber and a generally U-shaped outboard end which terminates in an elongated apertures axle element that is adapted to rotatably support a porous paint roller.

In addition, the paint delivery unit includes a paint reservoir member attached to the inboard end of the handle member and provided with an air inlet conduit and a paint outlet conduit, and a pump member disposed within the inboard end of the handle member for providing pressurized air through the hollow handle member, as well as the air inlet conduit so that pressurized paint from the reservoir member and pressurized air from the handle member will be mixed together in the elongated apertured axle element on the outboard end of the handle member for delivering paint on demand to the porous paint roller.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
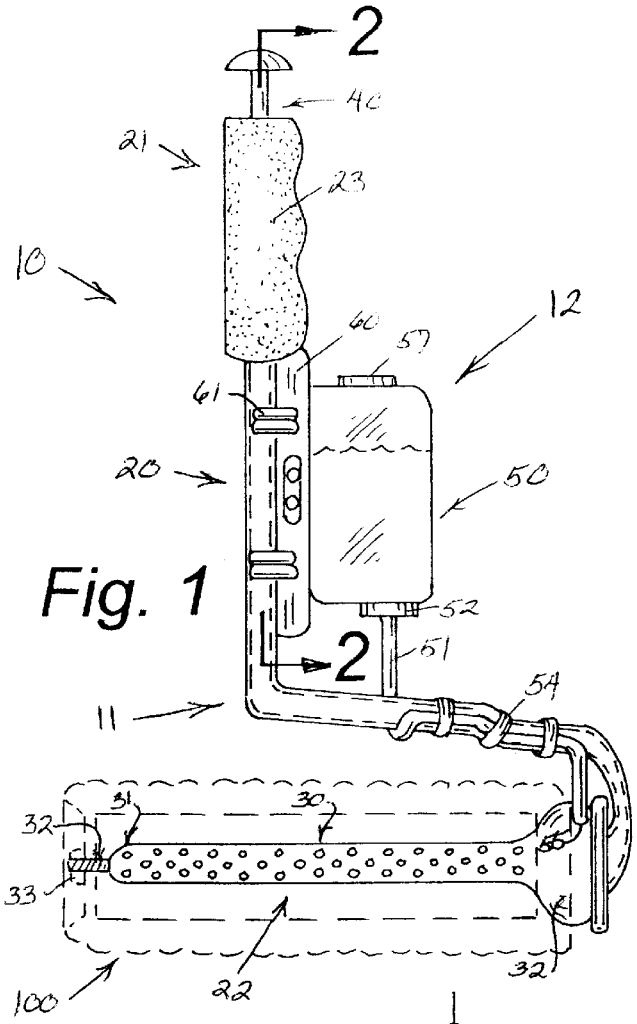
FIG. 1 is a front elevation view of the handle construction that forms the basis of this invention.

As can be seen by reference to the drawings, and in particular to FIG. 1, the handle construction for a paint roller that forms the basis of the present invention is designated generally by the reference number 10. The handle construction comprises in general a paint roller support unit 11, and a pressurized paint delivery unit 12. These units will now be described in seriatim fashion.

As shown in FIG. 1, the paint roller support unit 11 comprises an elongated contoured hollow handle member 20 having a generally straight inboard end 21 and a generally U-shaped outboard end 22 which terminates in an elongated apertured stationary axle element 30 whose purpose and function will be described in greater detail further on in the specification.

Figure 2:
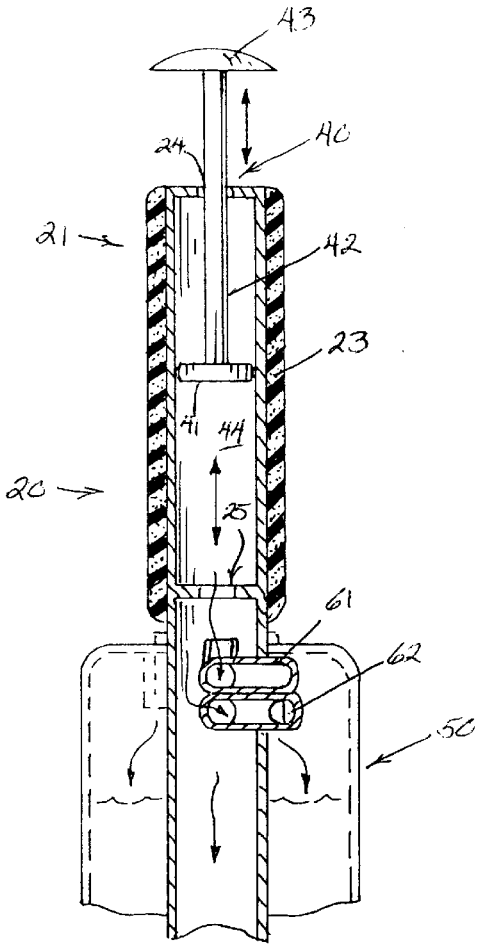
FIG. 2 is a partial cut away view of the inboard end of the handle construction.

As can also be seen by reference to FIGS. 1 and 2, the exterior surface of the inboard end 21 of the hollow handle member 20 is provided with a cushioned hand grip element 23, and as clearly shown in FIG. 2, the top of the inboard end 21 of the handle member 20 is provided with a centrally disposed aperture 24 and the intermediate portion of the inboard end 21 of the handle member 20 is provided with an apertured interior partition 25 spaced from the top of the inboard end 21 of the handle member 20 whose purpose and function will be described presently.

Figure 3:
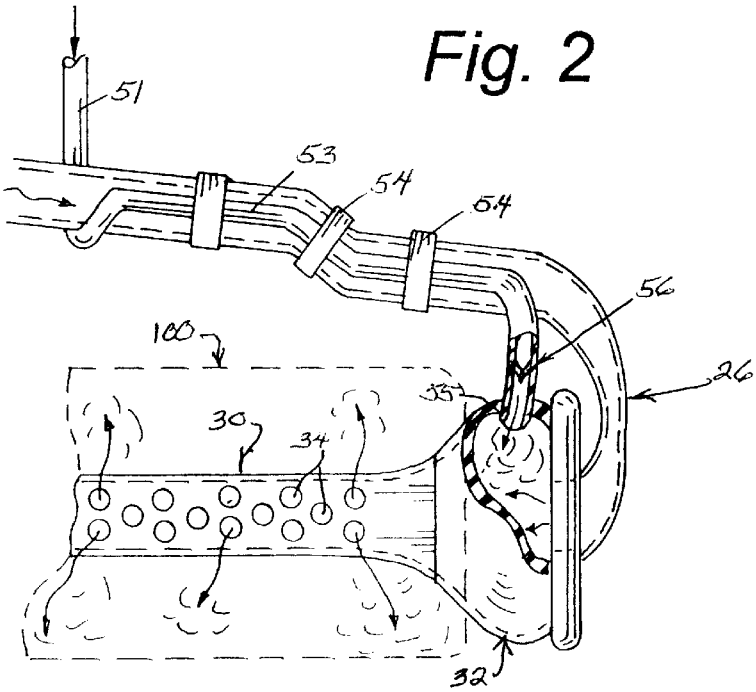
FIG. 3 is a partial cut away view of the outboard end of the handle construction.

As can be seen by reference to FIGS. 1 and 3, stationary axle element 30 has an outboard end 31 provided with a centrally disposed threaded post 32 which is provided with a fastener element 33 for loosely captively engaging and rotatably supporting the outer end of a porous absorbent paint roller designated generally as 100.

In addition, the stationary axle element 30 is provided with an enlarged bulbous shaped inboard end 32 which will rotatably support the inboard end of a paint roller 100.

At this juncture, it should be noted that the hollow handle member 20 has a fairly uniform internal diameter from its inboard end 21 to the point where the curved portion 26 of the outboard end 22 of the handle member 20 joins with the enlarged bulbous end 32 of the stationary axle member 30.

As shown in FIGS. 1 through 3, the pressurized paint delivery unit 12 comprises in general, a pump member 40 disposed within the inboard end 21 of the handle member 20. The pump member 40 is in fluid communication both with the interior of the hollow handle member 20 and the stationary axle element 30, as well as with a paint reservoir member 50 for delivery of both paint and pressurized air into the bulbous end 32 of the apertured axle element as will be described presently.

As can best be seen by reference to FIGS. 1 and 2, the pump member 40 includes piston head 41 mounted on the lower end of an elongated shaft element 42 which is dimensioned to pass through the central aperture 24 in the handle member 20. The upper end of the shaft element 42 is provided with an enlarged plunger handle 43 for moving the piston head 41 in a reciprocatory fashion within the pumping chamber 44 formed within the interior of the hollow handle member 20.

Still referring to FIGS. 1 and 2, it can be seen that the paint reservoir member 50 is attached to the exterior of the handle member 20 by a mounting bracket 60 that is provided with an air inlet conduit 61 which establishes fluid communication from the interior of the inboard end 21 of the hollow handle member 20 into the paint reservoir member 50. The interior of the air inlet conduit is provided with a one way split diaphragm valve 62.

When the plunger handle 43 is pressed downwardly as depicted in FIG. 2, the piston head 41 will force air through the apertured partition 25 in the hollow handle member 20. The pressurized air will flow downwardly both through the hollow handle member 20 and into the air inlet conduit 61. The air that passes through the one way valve 62 will pressurize the air within the fluid reservoir chamber 50.

As can be appreciated by reference to FIGS. 2 and 3, the fluid reservoir member 50 is further provided with a paint outlet conduit 51 having an inlet end 52 which is provided in the bottom of the paint reservoir member 50. The intermediate portion 53 of the paint outlet conduit 51 is secured to the exterior of the hollow handle member 20 via a plurality of securing bands 54.

In addition, the paint outlet conduit 51 has an outlet end 55 which terminates in the bulbous end 32 of the stationary axle element 30 and is further provided with a one way split diaphragm valve 56 that will allow the pressurized paint from the reservoir member 50 to enter the stationary axle element 30 and be mixed with the pressurized air flowing through the hollow handle member 20 to force the paint along the length of the stationary axle element 30. This combined action facilitates the distribution of the paint among the plurality of apertures 34 in the axle element 30 and from there to the interior surface of the porous roller 100 to maintain a regularly available replenishment supply of paint to the roller surface.

Returning once more to FIG. 1, it can be seen that the reservoir member 50 is further provided with a removable filler cap element 57 whereby the paint reservoir member 50 can be refilled when necessary in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A handle construction for a paint roller having a self contained paint supply wherein the handle construction comprises:

a paint roller support unit including an elongated contoured hollow handle member having a generally straight inboard end and a generally U-shaped outboard end which terminates in an apertured axle element dimensioned to rotatably receive a porous paint roller; and a pressurized paint delivery unit including a paint reservoir member attached to the hollow handle member and having an air inlet conduit in communication with the hollow handle member and a paint outlet conduit in communication with the apertured axle element, and a pump member disposed within the hollow handle member and adapted to deliver pressurized air through the hollow handle member and pressurized paint to the apertured axle element.

2. The construction as in claim 1 wherein the paint reservoir member is attached to the generally straight inboard end of the hollow handle member by a mounting bracket.

3. The construction as in claim 2 wherein the pump member is at least partially disposed within the generally straight inboard end of the hollow handle member.

4. The construction as in claim 3 wherein the air inlet conduit and the paint outlet conduit are both provided with one way valves.

5. The construction as in claim 4 wherein the paint outlet conduit has an inlet end connected to the paint reservoir member, an outlet end connected to one end of the axle element and an intermediate portion connected to the U-shaped outboard end of the hollow handle member.

6. The construction as in claim 5 wherein the apertured axle element has an enlarged inboard end and an outboard end adapted to releasably engage and rotatably suspend one end of a paint roller.

7. The construction as in claim 6 wherein the outlet end of the paint outlet conduit is connected to the enlarged inboard end of the axle element.

8. The construction as in claim 7 wherein the pump member includes a piston head disposed within the inboard end of the hollow handle member and mounted on one end of an elongated shaft wherein the other end of the elongated shaft projects outside of the inboard end of the hollow handle member.

9. The construction as in claim 8 wherein the hollow handle member further includes an apertured interior partition spaced from the top of the inboard end of the hollow handle member and disposed below the piston head of the pump member.

* * * * *